United States Patent [19]

Fischer

[11] 4,445,419

[45] May 1, 1984

[54] AMMUNITION CONTAINER, ESPECIALLY DRUM MAGAZINE

[75] Inventor: Pierre Fischer, Geneva, Switzerland

[73] Assignee: Werkzeugmaschinenfabrik Oerlikon-Bührle AG, Zürich, Switzerland

[21] Appl. No.: 419,763

[22] Filed: Sep. 20, 1982

[30] Foreign Application Priority Data

Oct. 14, 1981 [CH] Switzerland ..... 6560/81

[51] Int. Cl.[3] ..... F41D 10/26

[52] U.S. Cl. ..... 89/33 D; 42/1 MH; 89/33 BB; 89/34

[58] Field of Search ..... 89/33 D, 33 BB, 33 BC, 89/34, 33 C, 33 CA, 35 R, 35 A; 42/1 MH

[56] References Cited

U.S. PATENT DOCUMENTS

| | | | |
|---|---|---|---|
| 2,110,160 | 3/1938 | Larsson | 89/34 |
| 2,452,545 | 11/1948 | Broga . | |
| 4,037,344 | 7/1977 | Reed | 42/1 MH X |

FOREIGN PATENT DOCUMENTS

| | | | |
|---|---|---|---|
| 2051355 | 4/1972 | Fed. Rep. of Germany | 89/34 |
| 1572100 | 6/1969 | France . | |
| 2049199 | 3/1971 | France . | |
| 2037690A | 12/1978 | United Kingdom . | |
| 2076129 | 11/1981 | United Kingdom | 89/34 |

*Primary Examiner*—Donald G. Kelly
*Attorney, Agent, or Firm*—Werner W. Kleeman

[57] ABSTRACT

An ammunition container, especially a drum magazine, is subdivided by side walls into a plurality of sector-shaped compartments. Within the ammunition container there is located a cartridge belt, and protruding into each compartment is a loop of such cartridge belt. Each loop of the cartridge belt consists of two loop portions which bear against the side walls of the drum magazine. By means of magnets, located between the side walls of the drum magazine and the loop portions of the cartridge belt, the cartridges are secured against unintentional shifting.

5 Claims, 2 Drawing Figures

AMMUNITION CONTAINER, ESPECIALLY DRUM MAGAZINE

BACKGROUND OF THE INVENTION

The present invention relates to a new and improved construction of an ammunition container, especially a drum magazine, which is of the type containing a compartment for receiving a loop of a cartridge belt composed of two adjacently arranged loop portions, each loop portion bearing against a side wall of the compartment.

With a state-of-the-art ammunition container of the afore-mentioned type, for instance as disclosed in Swiss Pat. No. 577,669, the compartment contains a gear rack-like support and the gaps or spaces of such gear rack-like support serve for receiving a respective cartridge of the one loop portion.

This known cartridge container is afflicted with the drawback that in each compartment there only can be taken-up the cartridges of the one loop portion in the gaps or spaces of the gear rack-like support or carrier. Therefore, it is not possible to secure the cartridges of the other loop portion against unintentional shifting or displacement. This particularly is of significance if the cartridge tips of the ammunition are sensitive and these cartridge tips can not be used for guiding the cartridges in the ammunition container. In particular, in the case of a drum magazine the danger exists that the cartridge belt will unintentionally move towards the center of the drum magazine, will bind or jam in the compartment which becomes narrower, and hinder or render impossible removal of the cartridge belt from the ammunition container.

SUMMARY OF THE INVENTION

Therefore, with the foregoing in mind it is a primary object of the present invention to provide a new and improved construction of ammunition container, especially a drum magazine, which is not afflicted with the aforementioned drawbacks and limitations of the prior art proposals.

Another and more specific object of the present invention aims at the provision of a new and improved construction of ammunition container, wherein there is ensured for a reliable removal of the cartridge belt out of the compartments of the ammunition container, especially a drum magazine, for both portions or parts of the loop of the cartridge belt, so that such removal can be accomplished without the need for applying great forces and the loops of the cartridge belt within the ammunition container are precluded from participating in any unintentional or undesired shifting or displacement.

Still a further significant object of the present invention is directed to a new and improved construction of ammunition container, especially a drum magazine, which is relatively simple in construction and design, relatively easy to manufacture, highly reliable in operation, and ensures for reliable removal of the cartridge belt out of the compartments of the ammunition container without any danger of jamming of the cartridge belt within the ammunition container.

Yet a further significant object of the present invention is directed to a new and improved construction of ammunition container equipped with means which safeguards against undesired shifting of the cartridge belt within the ammunition container, so as to effectively prevent damage to cartridges or ammunition carried by the cartridge belt.

Now in order to implement these and still further objects of the invention, which will become more readily apparent as the description proceeds, the ammunition container of the present development is manifested by the features that between each loop portion of the cartridge belt and the side wall of the compartment there is arranged a magnet which is secured to each side wall, this magnet attracting the loop portion and securing it against any displacement towards the center of the drum magazine.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
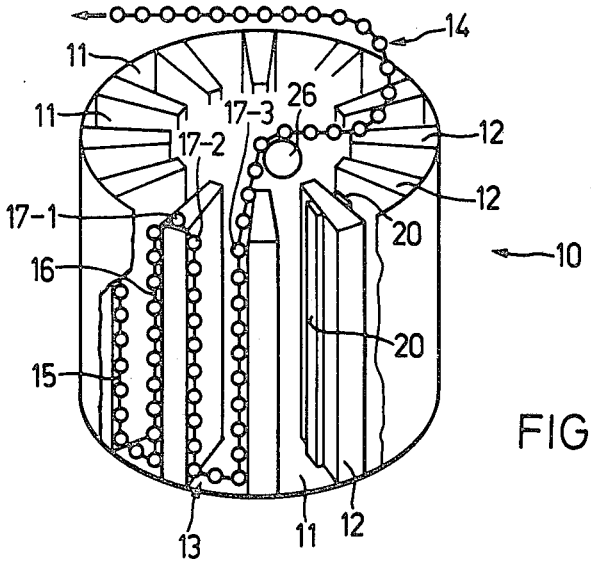
FIG. 1 is a perspective view of an ammunition container, here shown in the form of a drum magazine constructed according to the invention.

Describing now the drawings, it is to be understood that only enough of the construction of the ammunition container has been shown in order to simplify the illustration and as needed to enable those skilled in the art to readily understand the underlying principles and concepts of the present development. Turning attention specifically to FIG. 1, there will be recognized an ammunition container in the form of a drum magazine 10 which contains a number of sector-like compartments 11 which are mutually separated from one another by side or partition walls 12. Within each compartment 11 of the drum magazine 10 there is located a loop 13 of a cartridge belt 14. To simplify the illustration in the drawings only two of the compartments 11 have been shown filled with the loops 13 of the cartridge belt 14, whereas the remaining compartments 11 have been illustrated in a manner where the cartridge belt loops have already been emptied therefrom. Each loop 13 of the cartridge belt 14 consists of two loop portions or parts 15 and 16 which depend from the upper edge of the side walls 12, these loop portions 15 and 16 being interconnected with one another and bearing against the related side walls 12 of the compartments 11 of the drum magazine 10. A drive motor 26, which has only been schematically represented in the showing of FIG. 1 by a circle but may be of any conventional construction, serves for the removal of the cartridge belt 14 and for the infeed of the cartridge belt 14 to a firing weapon which has not been particularly shown in the drawings since it forms no part of the subject matter of the invention. At one of the side or partition walls 12 shown in the arrangement of FIG. 1 there are provided two rod-shaped magnets 20. Of course, at each side or partition wall 12 of the drum magazine 10 there are provided two such rod-shaped magnets 20 which, however, in the schematic representation of FIG. 1 has been omitted from the other side walls to simplify the illustration. It will be seen that these magnets 20 which extend in the lengthwise direction of the related side or partition wall 12 are arranged at opposite faces thereof. Also, it is to be understood that the drum magazine 10 possesses a cylindrical wall and a floor, which however have not been particularly shown in order to reveal the internal structure of the drum magazine, and because the cylindrical wall and floor or base of the magazine itself also are conventional and do not directly form subject matter of the present invention.

Figure 2:
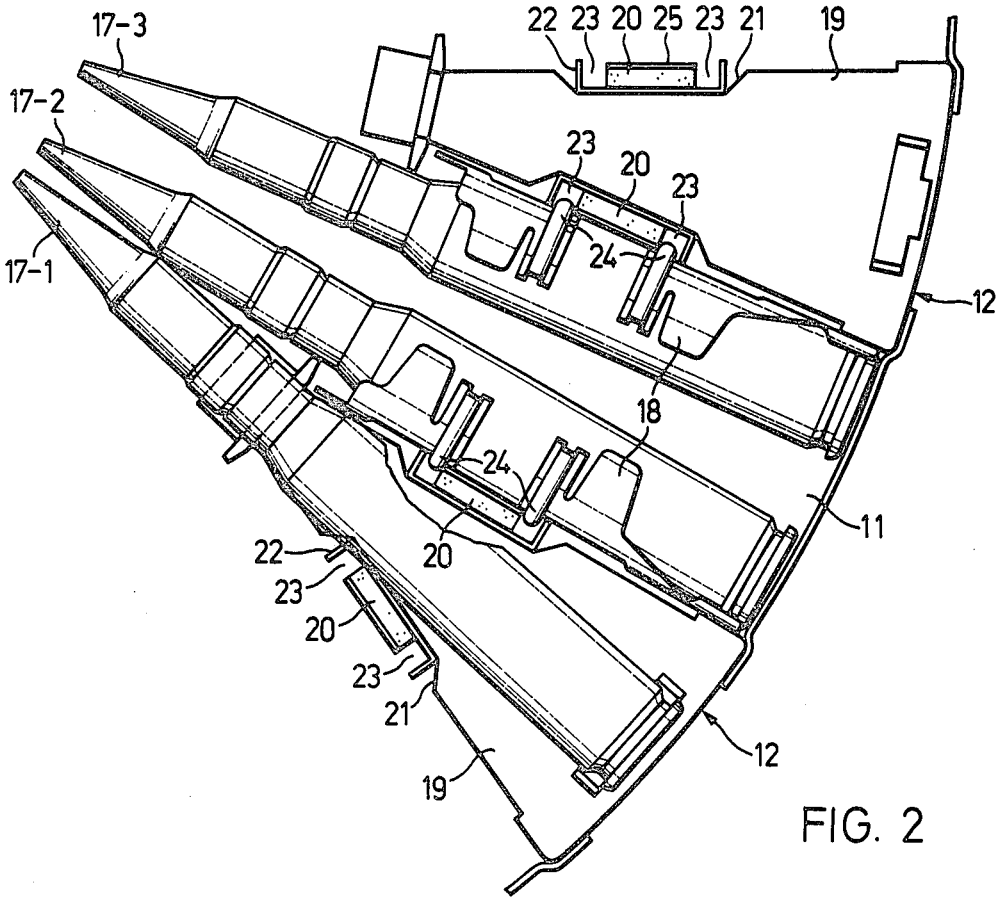
FIG. 2 is an enlarged fragmentary view of a portion of the drum magazine of the ammunition container depicted in FIG. 1.

Continuing, as best seen by referring to FIG. 2 there will be seen that each cartridge, such as the depicted cartridges 17-1, 17-2 and 17-3 are located in a related belt link or element 18. The individual belt links or elements 18 are conventionally interconnected with one another and form the cartridge belt 14 depicted in FIG. 1. In FIG. 2 there have only been illustrated these three cartridges 17-1, 17-2 and 17-3 located at the upper end of one of the compartments 11, and which cartridges have been designated by the same reference characters as in FIG. 1. As to the side or partition walls 12, in FIG. 2 there only are visible the upper end surfaces 19. Each side or partition wall 12 possesses two recesses or troughs 21 or equivalent structure in which there are secured the magnets 20 which may be permanent magnets. Each magnet 20 is located in a rail member 22 having a substantially U-shaped configuration in cross-section and each magnet 20 possess a substantially rectangular cross-sectional area or configuration. Each magnet 20 together with its related rail or rail member 22 form two longitudinal or lengthwise extending grooves or channels 23 into which protrude two dogs or cams 24 or equivalent structure of the associated belt element 18. By virtue of the magnetic force of the magnets 20 and due to the action of the dogs or cams 24 guided in the lengthwise extending channels or grooves 23 there is effectively precluded that the cartridge belt 14 will shift unintentionally towards the center of the drum magazine 10. The permanent magnets 20 are appropriately fixed in any suitable and therefore not particularly illustrated fashion, for instance by being bolted, to the opposite faces of the side or partition walls 12 of the ammunition container 10. Between each magnet 20 and the ammunition belt 18 there is also secured at the magnet 20 a plate member 25.

The force of the magnet 20 is chosen such that the belt loops 13 of the cartridge belt 14 can be easily inserted into the compartments 11 of the drum magazine 10 and also again easily withdrawn therefrom by the action of the drive motor 26. However, the force of the magnets 20 is sufficiently great in order to prevent any undesired shifting or displacement of the cartridge belt 14 towards the center of the drum magazine 10.

Although in the exemplary embodiment the magnets 20 are constituted by permanent magnets, it is to be specifically understood that other magnets could be used, specifically also electromagnets.

While there are shown and described present preferred embodiments of the invention, it is to be distinctly understood that the invention is not limited thereto, but may be otherwise variously embodied and practiced within the scope of the following claims. Accordingly,

What I claim is:

1. An ammunition container arrangement, especially a drum magazine, comprising:

means defining a drum magazine;

side walls for dividing said drum magazine into a plurality of compartments for receiving loops of an ammunition belt;

each loop of the ammunition belt comprising two adjacently arranged loop portions;

each loop portion bearing against one of the side walls of its related compartment;

a respective magnet arranged between each loop portion of the cartridge belt and the related side wall of the compartment; and each such magnet being secured to its related side wall and attracting the loop portion of the ammunition belt in order to secure the same against displacement towards the center of the drum magazine.

2. The ammunition container arrangement as defined in claim 1, wherein:

each said magnet possesses a substantially rail-shaped configuration;

means cooperating with each magnet to provide lengthwise extending grooves; and said cartridge belt possessing cam means protruding into said lengthwise extending grooves, in order to prevent shifting of the cartridges towards the center of the drum magazine.

3. The ammunition container arrangement as defined in claim 2, wherein:

each magnet comprises a rod-like member having a substantially rectangular cross-sectional area; and said means cooperating with each magnet comprises a respective rail member possessing a substantially U-shaped cross-sectional configuration in which there is arranged the related magnet.

4. The ammunition container arrangement as defined in claim 3, wherein:

each said rail member cooperates with its related magnet such as to form said lengthwise extending grooves which are located to opposite sides of the magnet.

5. The ammunition container arrangement as defined in claim 3, wherein:

each of said magnets comprises a permanent magnet.

* * * * *